US008894166B2

(12) United States Patent
Laible

(10) Patent No.: US 8,894,166 B2
(45) Date of Patent: Nov. 25, 2014

(54) DOMESTIC APPLIANCE COMPRISING A TELESCOPIC PULL-OUT

(75) Inventor: Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 694 days.

(21) Appl. No.: 11/918,498

(22) PCT Filed: Mar. 23, 2006

(86) PCT No.: PCT/EP2006/061001

§ 371 (c)(1),
(2), (4) Date: Oct. 10, 2007

(87) PCT Pub. No.: WO2006/120056

PCT Pub. Date: Nov. 16, 2006

(65) Prior Publication Data

US 2009/0079312 A1 Mar. 26, 2009

(30) Foreign Application Priority Data

May 10, 2005 (DE) ..... 10 2005 021 591

(51) Int. Cl.
*A47B 96/04* (2006.01)
*F25D 25/02* (2006.01)

(52) U.S. Cl.
CPC ..... *F25D 25/025* (2013.01); *A47B 2210/17* (2013.01)
USPC ..... 312/402; 312/404; 312/333; 312/319.1

(58) Field of Classification Search
CPC ..... A47B 88/0477; A47B 88/0481; F25D 25/025
USPC ..... 312/402, 404, 408, 333, 334.44, 312/334.46–334.47, 319.1–319.2
See application file for complete search history.

(56) References Cited

U.S. PATENT DOCUMENTS

| | | | | |
|---|---|---|---|---|
| 5,207,781 | A * | 5/1993 | Rock | 312/319.1 |
| 5,474,375 | A * | 12/1995 | Hollenstein et al. | 312/319.1 |
| 7,380,410 | B2 * | 6/2008 | Rand et al. | 62/302 |
| 7,387,351 | B2 * | 6/2008 | Nam | 312/402 |
| 2003/0173882 | A1 * | 9/2003 | Koons | 312/404 |
| 2004/0000850 | A1 * | 1/2004 | Lam Harn et al. | 312/333 |
| 2004/0056573 | A1 * | 3/2004 | Chae | 312/404 |
| 2004/0164654 | A1 | 8/2004 | Liable | |
| 2004/0212283 | A1 * | 10/2004 | Gasser | 312/333 |

FOREIGN PATENT DOCUMENTS

DE 1 262 533 3/1968

OTHER PUBLICATIONS

International Search Report PCT/EP2006/061001.

* cited by examiner

*Primary Examiner* — Hanh V Tran
(74) *Attorney, Agent, or Firm* — Nixon & Vanderhye P.C.

(57) ABSTRACT

A cupboard-type domestic appliance is provided having a housing delimiting an interior in which a support can be displaced between a retracted and a pull-out stop position by a telescopic pull-out mechanism. The telescopic pull-out mechanism includes a first runner fastened on the housing and at least one second runner that can be displaced in a direction contrary to that of the first runner. A projection of the second runner is coupled to a self-retracting mechanism mounted on the housing at a distance to the runners.

33 Claims, 7 Drawing Sheets

DOMESTIC APPLIANCE COMPRISING A TELESCOPIC PULL-OUT

The present invention relates to a cupboard-type domestic appliance, in particular a refrigerator or freezer, the housing of which comprises an interior in which a support can be displaced by means of a telescopic pull-out between a retracted and a pulled-out stop position. In the case of a refrigeration device, for example, such a support can take the form of a pull-out tray or a drawer, or a shelf. Such a telescopic pull-out generally comprises a first and at least one second runner which can be displaced longitudinally with respect to one another, whereby rollers or balls can be provided between the runners in order to reduce friction and to allow the carrier to be pulled out and pushed in with a minimum expenditure of effort.

When such a telescopic pull-out simply comprises two runners, its maximum freedom of movement between the pushed-in and pulled-out stop positions is significantly less than the length of the runners. That is to say, the shorter the overlap between the runners, the greater the torsional moments occurring between the runners become for a given weight of the support. In order to guarantee a precise, positive guidance even when the overlap is small a very high mechanical stability is therefore required of the runners and a cost-escalating high material strength is thus required. This restriction of the freedom of movement means, however, that a support held by a telescopic pull-out having two runners can never be pulled out completely from the refrigerator. Items situated on a rear area of the support are therefore not easily accessible.

In order to solve this problem, telescopic pull-outs having three runners interleaved with one another have been proposed which are coupled to one another such that the path traveled by the center runner is always half as great as that of the runner to which the support is secured. Thus, even if the support is pulled out by an entire runner length, there is an overlap of half a runner length between the center runner and the two other runners. A stable, precise guidance of the support can be guaranteed in this manner.

As a consequence of the higher costs of such a telescopic pull-out associated with the increased number of runners, such pull-outs are used primarily in the case of refrigeration devices in the upper price sector. With regard to these refrigeration devices, so-called self-retracting mechanisms are also popular, in other words mechanisms which engage the telescopic pull-out shortly before it reaches the retracted stop position and automatically pull it into this stop position. Such self-retracting mechanisms are generally accommodated concealed in a space between the runners of the telescopic pull-out. Such a self-retracting mechanism is therefore generally specific to the type of the telescopic pull-out on which it is used. A self-retracting mechanism designed for a pull-out comprising three runners cannot simply be used on a pull-out having two runners and vice versa, with the result that the self-retracting mechanisms and the telescopic pull-outs in which they are used need to be manufactured in comparatively small and correspondingly high-priced series.

The object of the present invention is to create a domestic appliance which eliminates this specificity and makes it possible to use self-retracting mechanisms of the same type of construction manufactured inexpensively in large series in a plurality of different models of domestic appliances.

This object is achieved by a cupboard-type domestic appliance whose housing has an interior in which a support can be moved with the aid of a telescopic pull-out between a retracted and a pulled-out stop position, whereby the telescopic pull-out comprises a first runner secured to the housing and at least one second runner, which is capable of moving with respect to the first runner, and whereby a self-retracting mechanism is mounted on the housing separated from the runners and coupled to a projection of the second runner. The local separation of the self-retracting mechanism from the runner makes it possible to construct this without regard to the design of the runner, such that the same type of self-retractor can in principle interact with any desired telescopic pull-out which has the projection required to enable the coupling. Since the only invention-specific adaptation required to a telescopic pull-out is the projection of the second runner, any conventional telescopic pull-out can be made useable for the invention with a minimal expenditure of effort; since the costs of the projection are negligible, it is also conceivable to use telescopic pull-outs with the projection in a uniform manner in different domestic appliance models, regardless of whether or not a self-retracting mechanism is also associated with the telescopic pull-outs there.

Such a self-retracting mechanism can be combined with a basic telescopic pull-out having simply two runners capable of moving with respect to one another, with a telescopic pull-out with intermediate runner, as described above, or also with a telescopic pull-out which additionally comprises third and fourth runners permanently connected to one another, whereby the third runner is guided with freedom of movement on the first and the fourth runner guides the second. Although a telescopic pull-out of this latter type requires more individual parts in order to achieve the same freedom of movement as a pull-out with an intermediate runner, it does however have the advantage that it can be implemented in a particularly simple and inexpensive manner through simple combination of two basic pull-outs comprising two runners each.

In order to allow use without modification of all these different types of telescopic pull-outs in different appliance models according to the choice of the manufacturer with or without a self-retracting mechanism, the projection coupling to the self-retractor is preferably not formed directly on the second runner but on an adapter mounted on the latter. A telescopic pull-out which is not equipped with a self-retracting mechanism can then simply be provided with another adapter not having the projection.

The self-retracting mechanism preferably comprises a swiveling claw in which the projection engages in the retracted position and from which it is released in the pulled-out position, and which in each case assumes one of two stable positions when the telescopic pull-out is in the retracted position, and assumes the other when the telescopic pull-out is in the pulled-out position.

In order to ensure simple and reliable coupling between the projection and the claw, the projection preferably has a trunnion with a longitudinal axis parallel to the swivel axis of the claw, which interacts with the claw.

In order to implement the two stable positions of the claw, it is advantageously possible to use a tension spring which has a fixed first contact point with respect to the housing and a second contact point on the claw, whereby the swivel axis of the claw crosses an imaginary triangle which is defined by the first contact point, the second contact point in the first position of the claw and the second contact point in the second position of the claw.

In order to achieve a compact design for the self-retractor and be able to keep the distance between it and the telescopic pull-out small, it is advantageous if the swivel axis of the claw is capable of moving at right angles to the direction of motion of the second runner.

Further features and advantages of the invention are set down in the following description of embodiments with reference to the attached figures. In the drawings.

Figure 1:
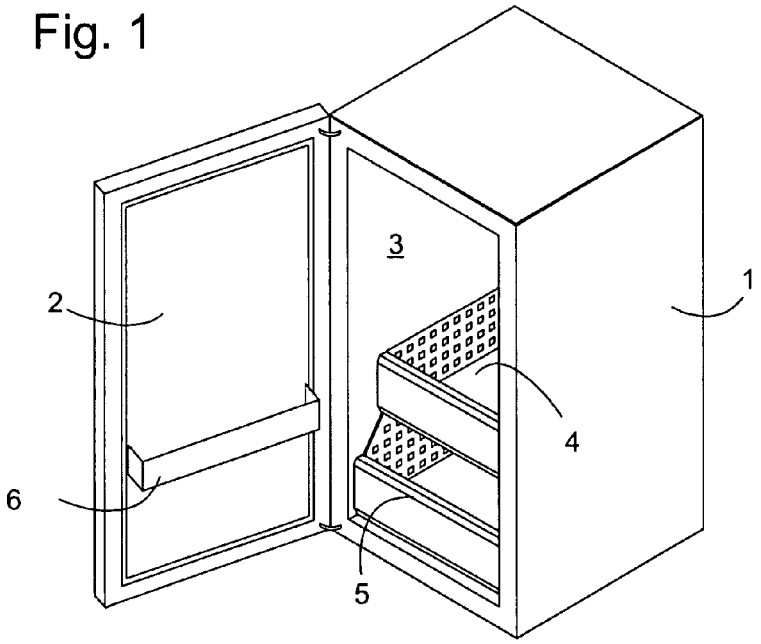
FIG. 1 shows a perspective view of a refrigeration device.

FIG. 1 shows a perspective view of a refrigeration device with a body 1 and a door 2. In a refrigerated chamber 3 in the interior of the device, two chilled goods supports 4, 5 in the form of pull-out trays are shown by way of example. The pull-out trays 4, 5 are held capable of sliding on telescopic pull-outs, not visible in the figure, hung on the side walls of the body 1. The upper pull-out tray 4 has a smaller depth than the lower one 5 in order to allow space for a door shelf 6 affixed to the door 2.

In the upper area of the refrigerated chamber 3 left empty in the figure further chilled goods storage facilities can be installed, according to requirements in the form of further pull-out trays or in the form of stationary or slidable shelves.

Figure 2:
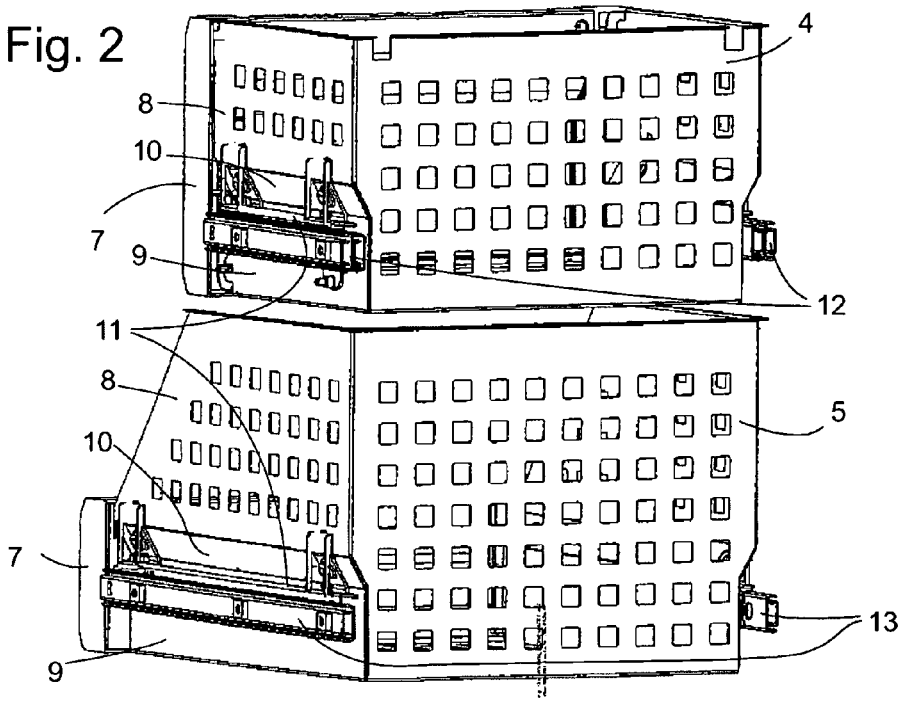
FIG. 2 shows a perspective view of two chilled goods supports of the refrigeration device from FIG. 1.

FIG. 2 shows the two pull-out trays 4, 5 in a perspective view from the rear. The pull-out trays 4, 5 each comprise a basket formed from perforated metal, whose front side facing the door is faced with a plastic panel 7. In the case of the upper pull-out tray 4 this panel 7 extends over its entire height, in the case of the lower tray 5 it extends over only part of the height such that an access opening is formed between the panel 7 and the tray 4 situated above it, as can be seen in FIG. 1, which allows access to the contents of the tray 5 without the latter being pulled out.

Figure 4:
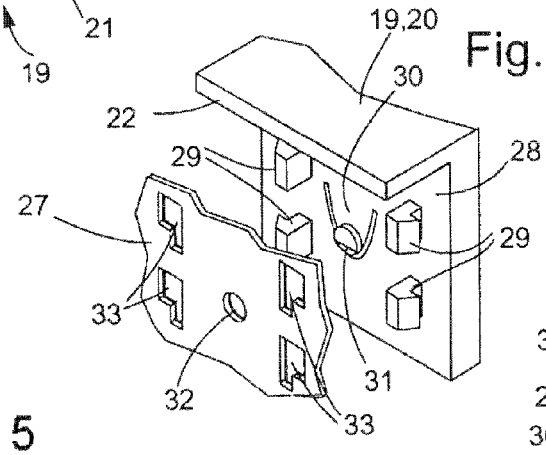
FIG. 4 shows fragments of each of a telescopic pull-out runner and an adapter which illustrate how the adapter is secured to the runner.
Figure 8:
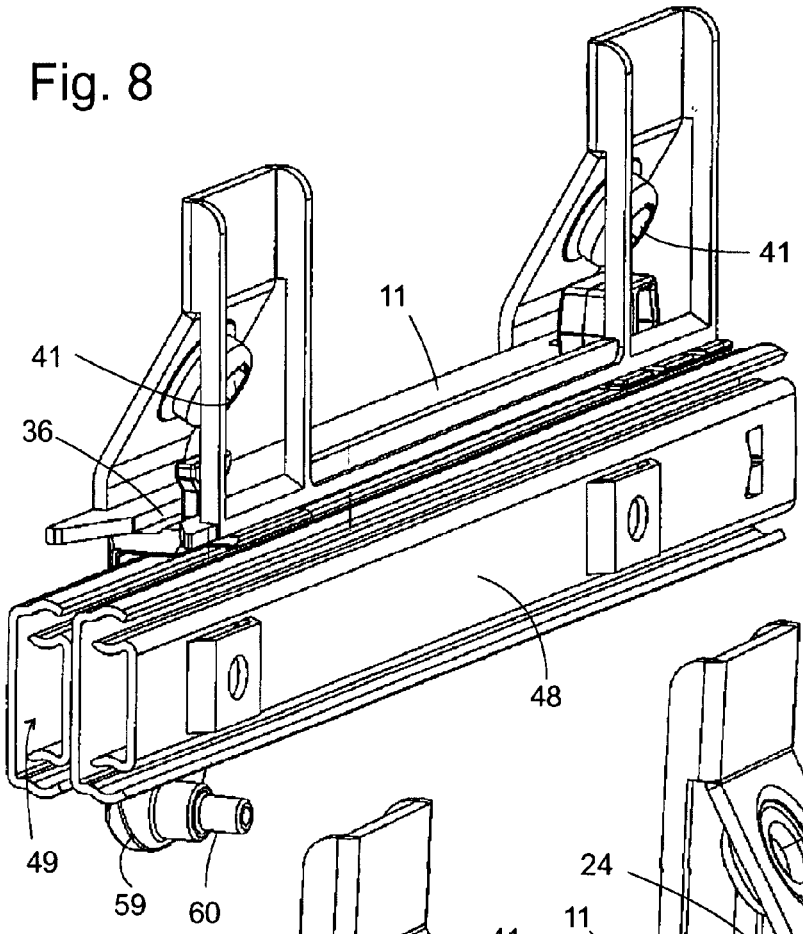
FIG. 8 shows the combined telescopic pull-out from FIG. 7 with support element mounted thereon, viewed from the side of the pull-out facing the side wall of the body.
Figure 9:
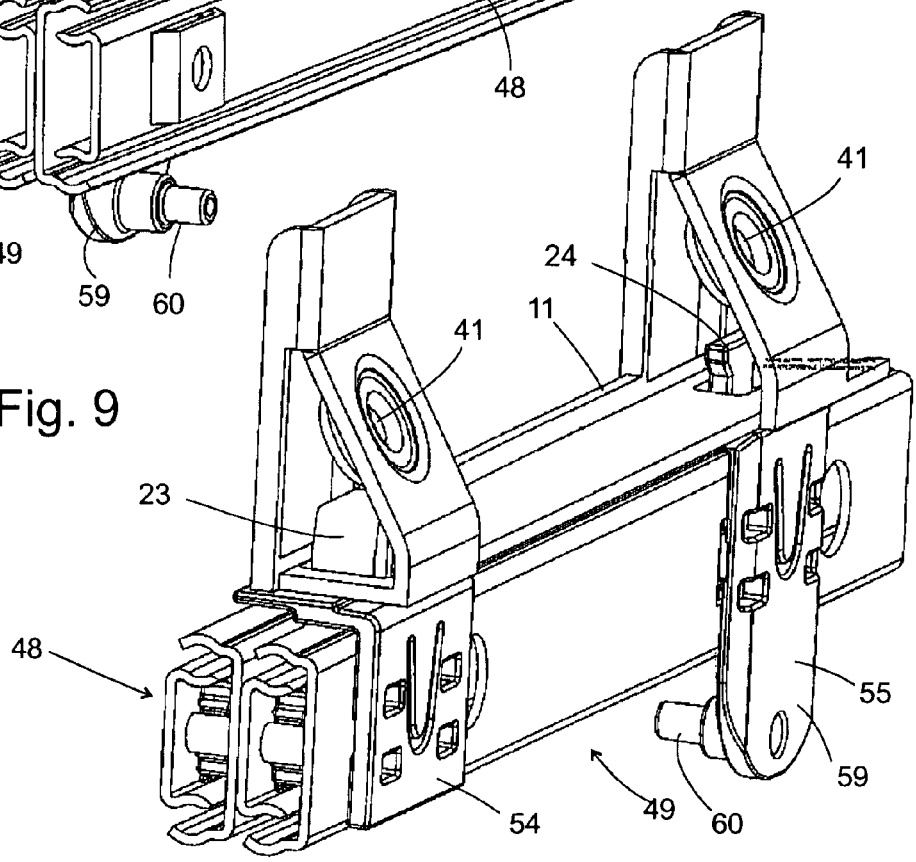
FIG. 9 shows a perspective view of the combined telescopic pull-out and the support element, viewed from the refrigerated chamber of the refrigeration device.

The side walls of the baskets each have vertical upper and lower wall sections 8 and 9 and between these are sloping shoulders 10 which slope downwards and inwards towards one another. In each case, an injection-molded support element 11 made of plastic, which can be seen more precisely in FIGS. 4, 8 and 9, is affixed to the shoulders 10. The support elements 11 in turn are braced against telescopic pull-outs 12 and 13 by way of adapters.

The telescopic pull-outs 13, against which the lower pull-out tray 5 is braced, each comprise a pair of intermeshing runners. These runners have a freedom of movement with respect to one another of between 50 and 80% of their length; here it is equal to the depth of the pull-out tray 4 situated above, with the result that in the position where it is pulled out to the stop the pull-out tray 5 is pulled out completely beneath the tray 4 situated above and is freely accessible over its entire upper side.

Figure 3:
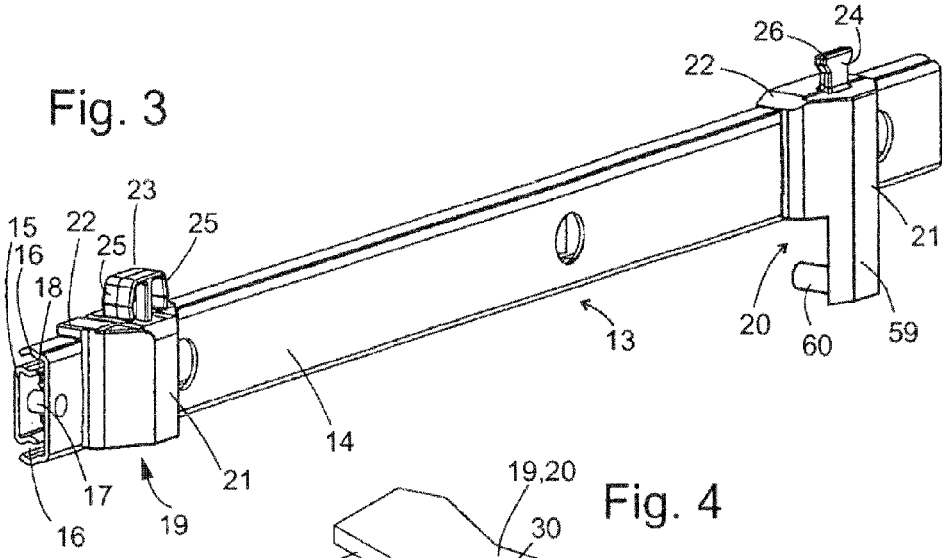
FIG. 3 shows a perspective view of a left-hand telescopic pull-out of the lower chilled goods support.

FIG. 3 shows a perspective view of one of the telescopic pull-outs 13 of the lower pull-out tray 5, namely the left-hand pull-out 13 from the perspective of an observer looking into the refrigerated chamber 3. The pull-out comprises two runners made from bent sheet steel, an outer runner 14 with an approximately C-shaped cross-section and an inner runner 15 engaging in the hollow section of the outer runner 14. Side pieces situated opposite one another on the runners 14, 15 delimit two cylindrical channels 16 in which in each case are housed a plurality of balls not visible in the figure, which guide the runners 14, 15 such that they move easily with respect to one another and with little free play. A pin 17 stands out from the front end of the outer runner 14 into the space between the runners 14, 15. Its contact with a rubber buffer 18, which can still just be recognized in the figure, secured to the inner runner 15 defines a limit of the freedom of movement of the runners 14, 15 with respect to each another.

A front adapter 19 and a rear adapter 20 made of plastic are secured to the outer runner 14. The adapters 19, 20 here in each case have an approximately blunt prism shaped basic body 21, onto which is formed on its upper surface a horizontal crosspiece 22 situated on the upper side piece of the runner 14.

An engagement element 23 or 24 stands out from the upper surface of the basic body 21 in each case. The engagement element 23 on the front adapter 19 has approximately the shape of the letter T in section, whereby two elastic side pieces 25 running downwards and initially apart, then towards each other again are formed onto the ends of the crossbar of the T. The engagement element 24 on the rear adapter 20 is a rigid trunnion which has a forward directed nose 26 on its upper end.

The basic body 21 of the rear adapter 20 has a downward directed projection 59, out of which a horizontally oriented trunnion 60 extends in the direction of the side wall (not shown in the figure) of an inner container of the refrigeration device, to which the inner runner 15 is secured.

FIG. 4 is intended to illustrate the anchoring of the adapters 19, 20 to the runner 14. Shown separately from one other are a fragment 27 of the runner 14 and, facing the latter, a side of an adapter 19 or 20, whereby the type of anchoring is the same for both adapters 19, 20. The wall 28 of the adapter facing the fragment 27 carries four rigid engagement hooks 29 and an elastic tongue 30 cut free from the wall 28 by means of a U- or V-shaped slot, from whose tip a key 31 stands out. Opposite these in the runner 14 are situated a round hole 32 and four angular holes 33, the latter each having the form of a rectangle which is extended at its lower edge by a short slot. In order to anchor the adapter 19 or 20 on the runner 14, the engagement hooks 29 are introduced into the angular holes 33 and at the same time the tongue 30, whose key 31 pushes against the closed wall of the runner 14, is initially pushed back into the hollow basic body of the adapter. When the engagement hooks 29 have been completely pushed through the holes 33 and the wall 28 of the adapter is butting against the runner 14, the adapter can be pushed downwards so that the shanks of the engagement hooks 29 engage in the slots in the holes 33 and the crosspiece 22 comes to rest on the upper side piece of the runner 14. In this situation, the key 31 locates the round hole 32 and snaps into the latter. When this has happened, the adapter can then only be released from the runner 14 by first pushing the key 31 out of the hole 32 again using a tool and then lifting the adapter.

FIG. 5 again shows a perspective view of the telescopic pull-out 13 from FIG. 3, this time with a support element 11 engaged on it. The support element 11 incorporates an elongated base plate 34 which is supported on the upper surfaces of the adapters 19, 20. On the front end of the base plate 34 is formed a rectangular hole 35, through which the engagement element 23 of the adapter 19 is inserted. The sections of the elastic side walls 25 of the engagement element 23 sloping down towards one another press against the front and rear edge of the hole 35 and thus keep the base plate 34 pressed free of play against the adapter 19. The trunnion 24 of the rear adapter 20 engages in a slot 36 open to the rear in the base plate 34.

At both ends of the base plate 34, above the hole 35 and above the slot 36, a counter bearing is formed in each case for the basket of the pull-out tray 5. In each case the counter bearing comprises a sloping plate 37 which at its lower edge is joined to an edge of the base plate 34 facing the basket, and which at its upper edge is joined to two vertical braces 38 rising from the base plate 34 to form a U-profile section 39. In the center of the plate 37 is a flat depression 40 and in the center of this is formed a hole 41 which opens out to the rear of the plate 37 into a hexagonal cross-section.

Figure 6:
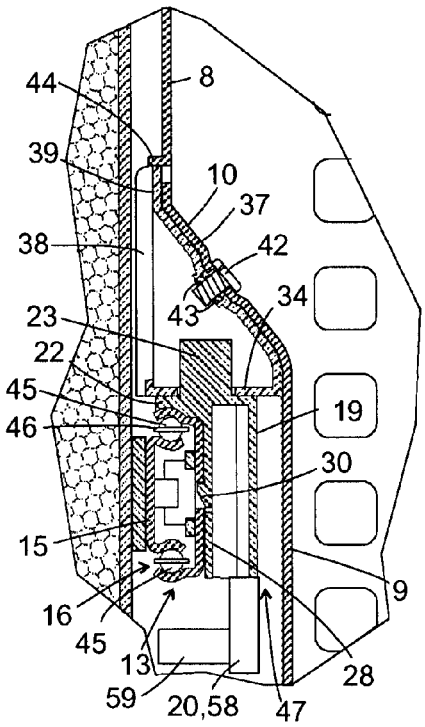
FIG. 6 shows a section through the telescopic pull-out from FIGS. 3 and 5 and its surroundings at the height of an adapter.

FIG. 6 shows a section through the telescopic pull-out and its surroundings at the height of the adapter 19. As this section shows, the hole 41 in the plate 37 serves to secure the shoulder 10 of the basket to it with the aid of a screw 42 and a nut 43 form-fitting in the hexagonal expansion of the hole. A lug 44 released from the upper section 8 of the basket side wall is supported on the upper edge of the U-profile section 39.

In the section, the previously mentioned balls 45 can be seen which, combined in multiples in a cage 46 in each case, are installed in the channels 16 between the runners 14, 15.

In addition, it can be seen that between the outer runner 14 and the lower wall section 9 of the basket opposite it there is a space 47 which is in part filled by the hollow basic body 21 of the adapters 19 and 20. The width of this space 47 is greater than that of the telescopic pull-out 13, which means that if required it is possible to accommodate a second telescopic pull-out therein without needing to change the dimensions of the pull-out tray 5 to do so.

In FIG. 2 it can be seen that such an arrangement of two coupled telescopic pull-outs is provided on each side of the upper pull-out tray 4. These coupled telescopic pull-outs give the pull-out tray 4 a freedom of movement which is greater than its depth, such that it can be pulled out completely beneath a chilled goods support of the same depth arranged above it, which is not shown.

Figure 7:
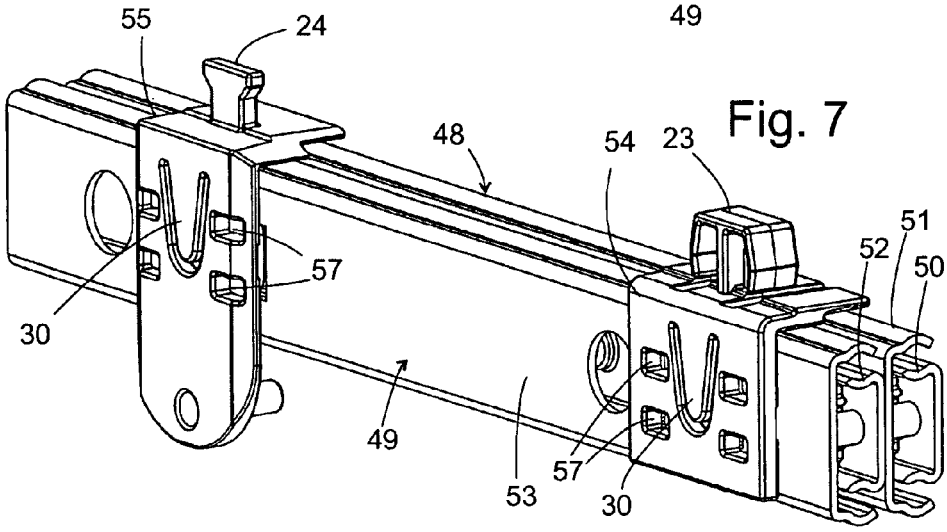
FIG. 7 shows a perspective view of a combined telescopic pull-out for the upper chilled goods support from FIG. 2.

FIG. 7 shows a perspective view of two telescopic pull-outs 48, 49 connected in series on the right-hand side of the pull-out tray 4 from the perspective of the user standing in front of the refrigerated chamber 3. The construction of the telescopic pull-outs 48, 49 with an inner runner 50 and 52 respectively and an outer runner 51 and 53 respectively, which are guided with the aid of balls 45 to move with respect to one another, is the same as in the case of the telescopic pull-out 13 and does not therefore need to be described again. The runners 51, 52 are rigidly joined to one another by means of rivets 58 shown in FIG. 10, of which the one or other can simultaneously serve as a stop to limit the freedom of movement of the pull-outs 48, 49.

The front and rear adapters 54 and 55 respectively are clamped to the runner 53 in analogous fashion to that described above with reference to FIG. 4. Instead of a wide hollow basic body as in the case of the adapters 19, 20, here only one narrow, plate-like basic body is provided, on whose visible side can be seen the elastic tongue 30 and recesses 57 located opposite the engagement hooks 29. The engagement elements 23, 24 carried by the adapters 54, 55 are the same as in the case of the adapters 19, 20.

Figure 5:
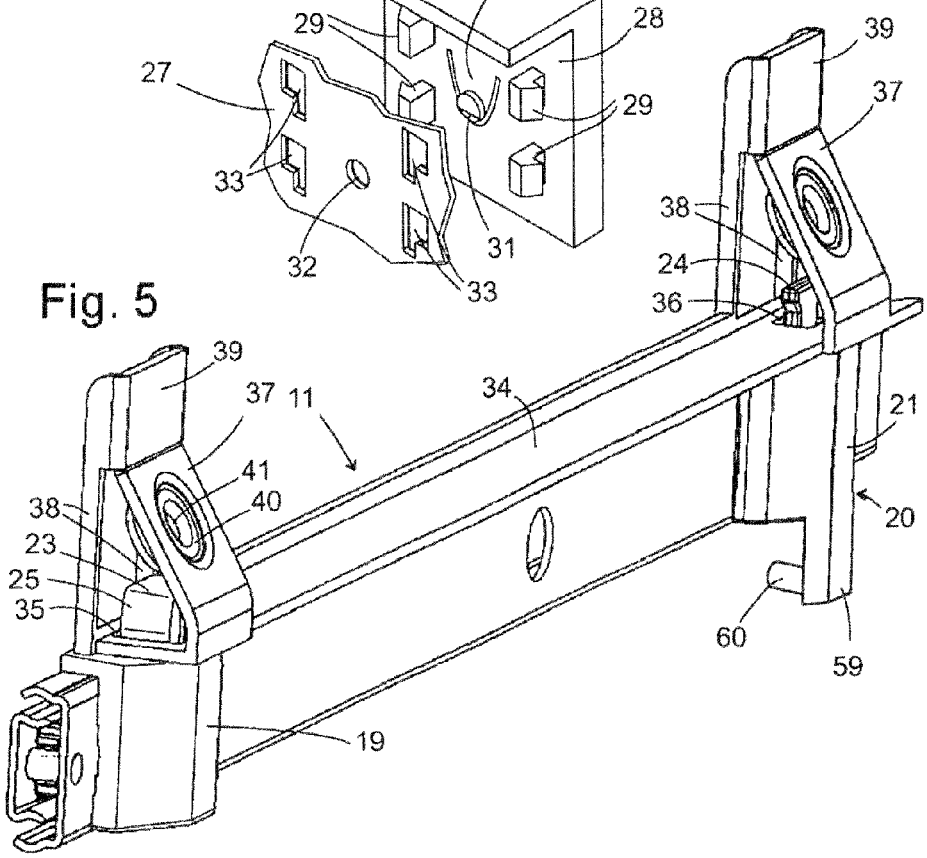
FIG. 5 shows the telescopic pull-out from FIG. 3 with support element mounted thereon.

The same type of support element 11 can therefore also be mounted on these adapters 54, 55, as can be seen in FIGS. 8, 9, as already described with reference to FIG. 5.

In this case also, the rear adapter 55 in each case is provided with a projection 59 projecting downwards over the undersides of the runners, which carries a trunnion 60 oriented horizontally towards the wall of the inner container. The function of the trunnion will be described in detail below with reference to FIG. 11 and following figures.

In the view illustrated by FIG. 8, which shows the side of the telescopic pull-outs 48, 49 and of the support element 11 facing the side wall of the body 1, the hexagonal expansion of the holes 41 and the slot 36 open to the rear, towards the rear wall of the body 1, in the base plate 34 of the support element 11 can be recognized in particular. Towards the rearward end of the base plate 34 the slot has diverging edges in order to facilitate fitting the slot onto the engagement element 24 of the rear adapter.

Figure 10:
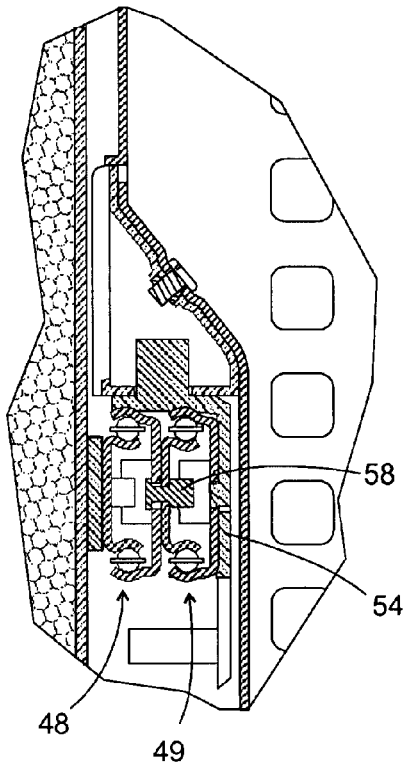
FIG. 10 shows a section analogous to FIG. 5 through the combined telescopic pull-out and its surroundings at the height of an adapter.

As can be seen in FIG. 10, the space 47 to the side of the wall section 9 of the basket is practically filled by the additional telescopic pull-out 49 and the plate-like basic body of the adapters 54, 55. The position of the engagement projections 23 and 24 is the same as shown in FIG. 6 in respect of the side wall of the body or the pull-out 48 mounted directly on this, with the result that identical support elements 11 and baskets can be mounted as required on a single pull-out such as 13 or a double pull-out such as 48, 49.

Figure 11:
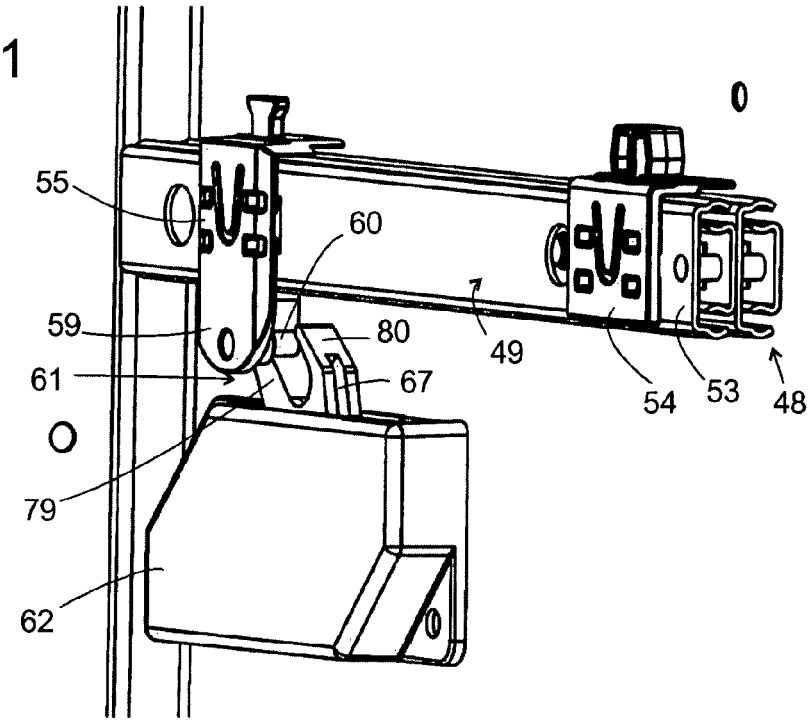
FIG. 11 shows a perspective view of the side wall of the inner container of the refrigeration device with combined telescopic pull-out mounted thereon and a self-retracting mechanism interacting with the latter.

FIG. 11 shows a perspective view of the side wall of the inner container of the refrigeration device with the two telescopic pull-outs 48, 49 coupled to one another mounted on it and the adapters 54, 55 clamped to the runner 53 of the telescopic pull-out 49. The telescopic pull-outs 48, 49 are in a retracted stop position. The trunnion 60 of the rear adapter 55 engages between two fingers 79, 80 of a forked claw 61. The claw 61 is part of a self-retracting mechanism which is largely concealed behind a housing 62 made of plastic secured to the inner container wall.

Figure 12:
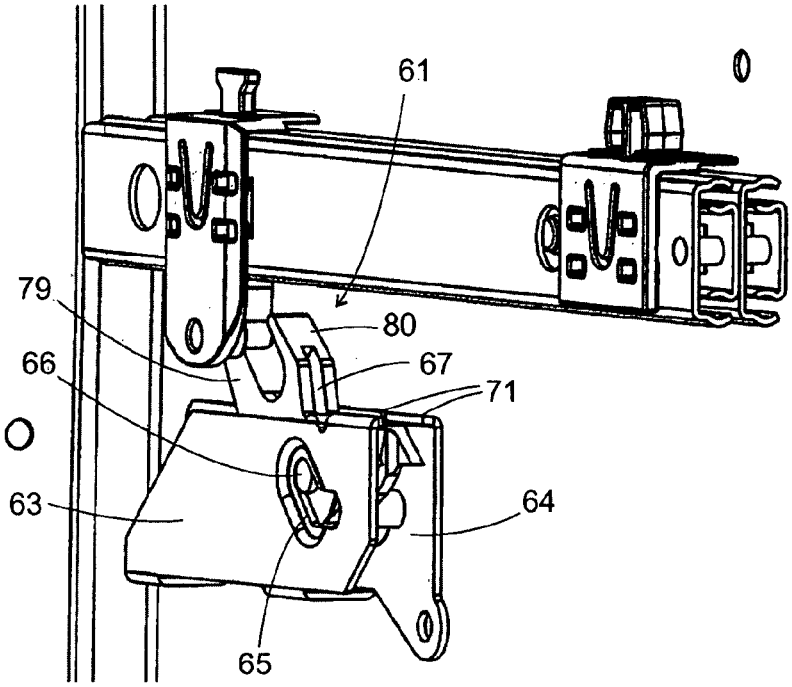
FIG. 12 shows the same perspective view as FIG. 11, but with the housing of the self-retracting mechanism omitted.

FIG. 12 shows the self-retracting mechanism without the housing 62. A one-part frame shaped from a steel sheet with two side plates 63, 64 in which elongated holes 65 aligned with one another in each case are formed can be seen. In the figure, only the elongated hole 65 in the side plate 63 facing the observer can be seen. The elongated holes 65 extend downwards at an angle towards the front side of the body and form a guide in which two cylindrical trunnions 66 standing out from the body of the claw 61 are held such as to be capable of movement. A slot 67 runs parallel to the inner container wall through a large part of the body of the claw 61.

Figure 13:
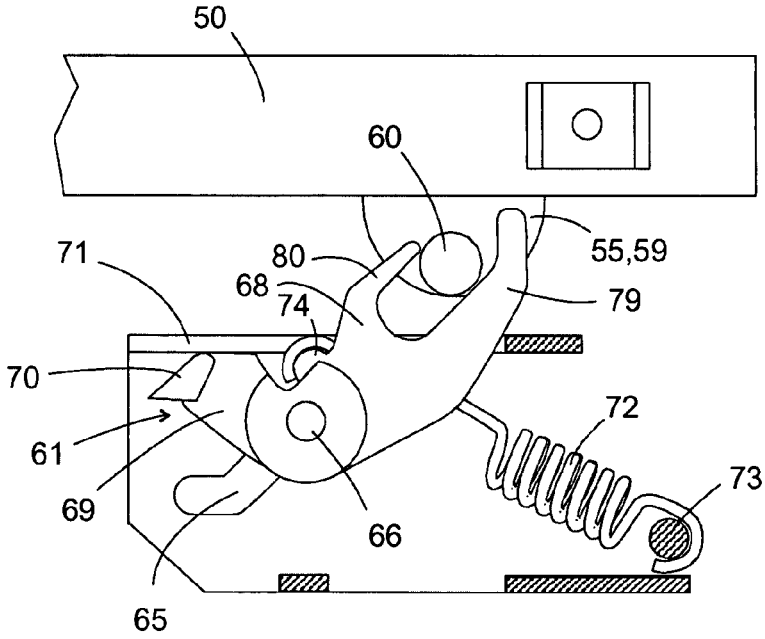
FIG. 13 shows a top view of the self-retracting mechanism with the frame shown cut in a stable position corresponding to the retracted stop position of the chilled goods support.

FIG. 13 shows the self-retracting mechanism in a top view of its side facing the inner container wall, whereby the side plate 64 is omitted. As can be seen here, the claw 61 is implemented as a two-armed lever, whereby one arm 68 carries the two fingers 79, 80 embracing the trunnion 60 and the second arm 69 carries a cross-piece 70 at its end, which extends with little free play across the entire width of the space between the two side plates 63, 64, and in the position illustrated abuts against the underside of two narrow bars 71 bent down from the upper edge of the side plate 63 or 64, which delimit an opening through which the arm 68 extends.

Figure 14:
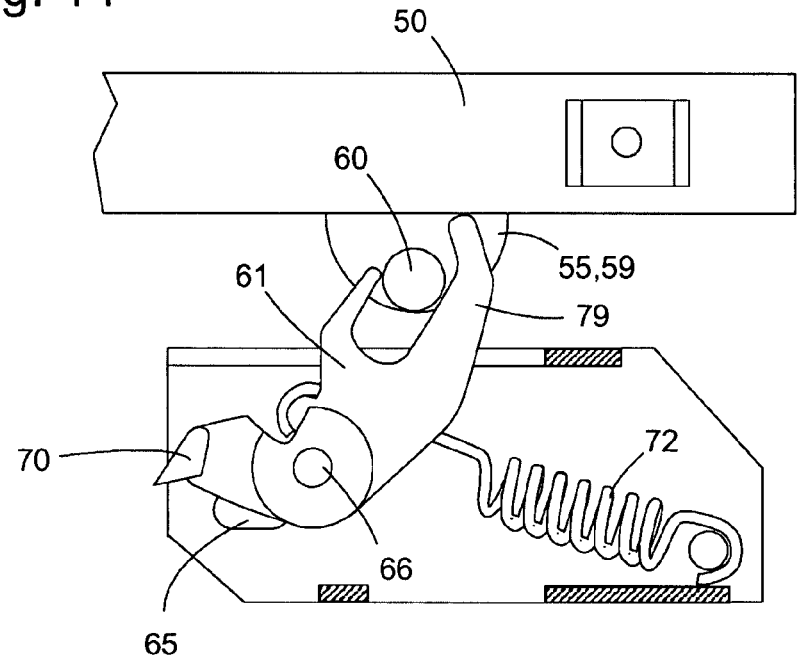
FIG. 14 shows a top view of the self-retracting mechanism in an unstable intermediate position.

A coil spring 72 is tensioned between a fixed pin 73 on the side plates 63, 64 and a pin 74 of the claw 61 crossing the slot 67. It extends through the slot 67 in such a way that it cannot slip off sideways from the pin 74. The tensile force of the coil spring 72 holds the claw 61 in the illustrated position, in which the trunnions 66 are situated at the upper end of the elongated holes 65 in each case and the cross-piece 70 presses against the bars 71. When the runner 53, which is hidden in FIG. 13, is pulled out with a chilled goods support mounted thereon and the adapter 55 secured to it moves forward, the claw 61 is carried along by the trunnion 60, as shown in FIG. 14. The coil spring 72 is extended by the pressure exerted by trunnion 60 and the trunnions 66 move forwards (to the left in the perspective of FIGS. 13, 14, 15) and downwards in the elongated holes 65, and the claw 61 rotates simultaneously. Through the combination of rotation and downward movement, the fingers 79, 80 of the claw 61 remain essentially at the same level, with the result that the self-retracting mechanism can be mounted closely adjacent to the runners 50 to 53 without the claw 61 hitting the runners while it is moving and being blocked by them.

Figure 15:
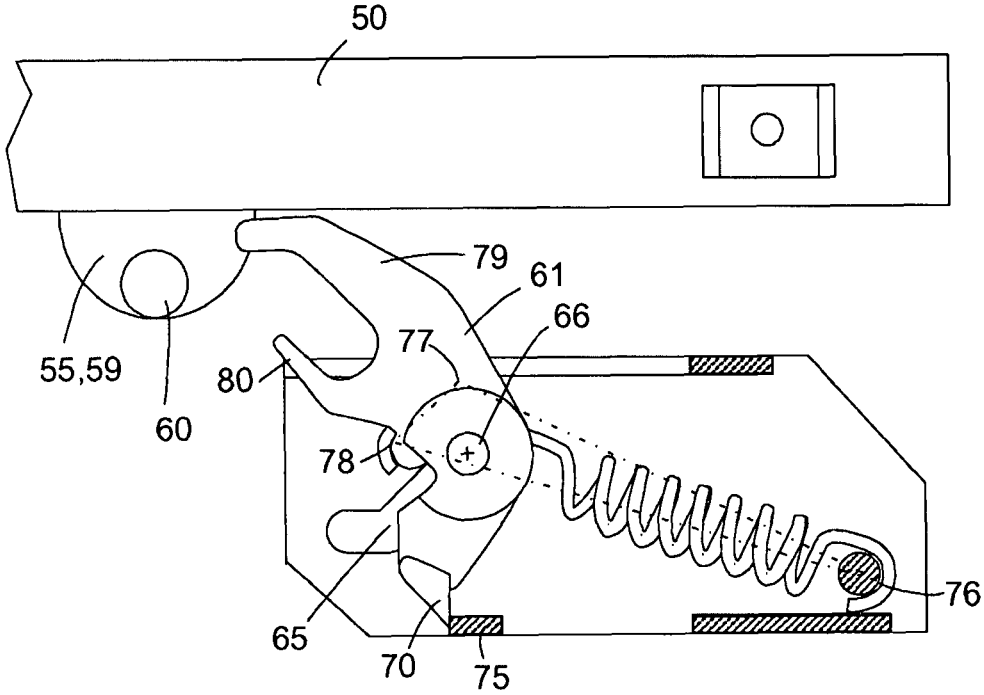
FIG. 15 shows a top view of the self-retracting mechanism in a second stable position corresponding to the pulled-out state of the chilled goods support.

When the runner 53 is pulled still further out, the claw 61 finally reaches the stop position shown in FIG. 15, in which the fingers 79, 80 release the trunnion 60. In this position the trunnions 66 of the claw 61 are pulled by the spring 72 back to the upper end of the elongated holes 65, and the cross-piece 70 butts against a strut 75 which joins the lower edges of the side plates 63, 64 to one another. A dot and dash triangle is drawn in FIG. 15 whose corners are defined in each case by the contact points 76, 77, 79 of the coil spring 72 with the pin 73, with the pin 74 in the stable position shown in FIG. 13 and with the pin 74 in the stable position shown in FIG. 15. As can be seen, the center point of the trunnions 66 and thus the rotational axis of the claw 61 lie inside this triangle, in close proximity to the side of the latter joining the contact points 76, 78 of the coil spring 72 in the position shown in FIG. 15. When the runner 53 is pushed back in again and its trunnion 60 engages the claw 61 and begins to carry this, a small pivoting angle of the claw 61 therefore suffices until the line joining the contact points crosses the rotational axis of the claw 61 and the claw 61 is swiveled further by the force of the coil spring 72 and in doing so carries the runner 53 right into its pushed-in stop position.

As can be easily seen, exactly the same type of self-retracting mechanism is also suitable for interacting with the trunnion 60 at the adapter 21 of the telescopic pull-out 13. In other words, the same self-retracting mechanism can be used both in the case of the simple telescopic pull-out 13 and also in the case of the combined pull-out consisting of two simple pull-outs 48, 49. It is easy to understand that, given an appropriately adapted design for the rear adapter, the same self-retracting mechanism can also be used in order to interact with a telescopic pull-out comprising three intermeshing runners.

The invention claimed is:

1. A cupboard-type domestic appliance comprising:

a.) a housing having a top wall and side walls delimiting an interior;

b.) at least one support; and c.) a telescopic pull-out positioned within a space defined by one of the side walls of the housing and the at least one support, the telescopic pull-out being operatively connected to the at least one support for guiding displacing movement of the at least one support into and out of the interior, the telescopic pull-out being movable between a retracted position and a pulled-out stop position and the telescopic pull-out having a first runner secured to the housing, a second runner that is movable with respect to the first runner, and a self-retracting mechanism mounted on the housing and separate from the runners, the second runner being secured to the at least one support by an adapter including a projection located between the at least one support and the side wall of the housing, the projection being engageable with the self-retracting mechanism mounted on the housing, wherein the adapter comprises a first portion located between the second runner and a side wall of the at least one support, the first portion being secured to the second runner and spaced apart from the side wall of the at least one support, the side wall of the at least one support opposing the side wall of the housing.

2. The domestic appliance as claimed in claim 1, wherein the self-retracting mechanism is arranged beneath the telescopic pull-out.

3. The domestic appliance as claimed in claim 1, wherein the self-retracting mechanism includes a swiveling claw in which the projection engages in the retracted position of the telescopic pull-out and from which it is released in the pulled-out position of the telescopic pull-out, and the swiveling claw assumes one of two stable positions when the telescopic pull-out is in the retracted position and assumes the other of the two stable positions when the telescopic pull-out is in the pulled-out position.

4. The domestic appliance as claimed in claim 3, wherein the projection has a trunnion with a longitudinal axis parallel to a swivel axis of the claw.

5. The domestic appliance as claimed in claim 4, wherein the trunnion has its free end directed away from the telescopic pull-out.

6. The domestic appliance as claimed in claim 4, wherein the projection is designed as a holding lug onto which the trunnion is formed as a single piece and the holding lug is fixed detachably at the rear part of the telescopic pull-out.

7. The domestic appliance as claimed in claim 6, wherein the trunnion is arranged on the holding lug beneath the telescopic pull-out.

8. The domestic appliance as claimed in claim 1, wherein the self-retracting mechanism includes a tension spring which has a fixed first contact point with respect to the housing and a second contact point on the claw, and a swivel axis of the claw crosses a triangle defined by the first contact point and the second contact point in the first position and in the second position of the claw.

9. The domestic appliance as claimed in claim 3, wherein a swivel axis of the claw is capable of moving at right angles to the direction of motion of the second runner.

10. The domestic appliance as claimed in claim 3, wherein the claw has a slot running at right angles to a swivel axis of the claw and a tension spring extends through the slot.

11. The domestic appliance as claimed in claim 1, wherein the telescopic pull-out has an intermediate runner inserted between first and second runner.

12. The domestic appliance as claimed in claim 1, wherein the telescopic pull-out includes third and fourth runners permanently connected to one another, whereby the third runner is guided in a manner permitting freedom of movement on the first runner and the fourth runner guides the second runner.

13. The domestic appliance as claimed in claim 1, wherein an engagement element is formed on the adapter for securing to the at least one support.

14. The domestic appliance as claimed in claim 1, wherein the size of the gap is fixed.

15. The domestic appliance as claimed in claim 14, wherein the second runner is spaced apart from the at least one support by a distance greater than a width of the second runner.

16. The domestic appliance as claimed in claim 1, wherein the domestic appliance is a refrigerator or a freezer.

17. The domestic appliance as claimed in claim 1, wherein there is a gap between the adapter and the at least one support.

18. The domestic appliance as claimed in claim 1, wherein the adapter comprises a second portion adjacent the first portion, the second portion being secured to the at least one support.

19. The domestic appliance as claimed in claim 18, wherein the second portion engages a top of the telescopic pull-out.

20. The domestic appliance as claimed in claim 1, wherein there is a gap between the projection and the at least one support.

21. A method of assembling a telescopic pull-out system for a support in a domestic appliance, the method comprising:

selecting at least one set of runners;

selecting an adapter from a plurality of interchangeable adapters configured to accommodate different numbers of runner sets;

securing the selected adapter to the support;

securing the at least one set of runners to the selected adapter; and securing a self-retracting mechanism to the domestic appliance, wherein the selected adapter includes a projection configured to engage the self-retracting mechanism.

22. The method of claim 21, wherein the plurality of adapters are also configured to accommodate different types of supports and the adapter is selected based on the type of support.

23. The method of claim 22, wherein the support is a shelf or a drawer.

24. The method of claim 21, wherein the at least one set of runners is selected from a plurality of interchangeable sets of runners.

25. The method of claim 21, wherein the domestic appliance is a refrigerator or a freezer.

26. The method of claim 21, wherein the support and the at least one set of runners comprise universal securing mechanisms and each of the interchangeable adapters is configured to be secured to the support and the at least one set of runners by way of the universal connecting mechanisms.

27. A cupboard-type domestic appliance comprising:

a housing having a top wall and side walls delimiting an interior;

at least one support movable inwardly toward the interior of the housing and outwardly away from the interior of the housing;

a self retracting mechanism mounted on the housing; and a telescopic pull-out assembly mounted within a space defined by one of the side walls of the housing and the at least one support, the telescopic pull-out assembly comprising:

a plurality of runners with an inner runner being closest to the at least one support and an outer runner being closest to the housing; and an adapter mounted on the inner runner, the adapter including a securing mechanism and a projection engageable with the self-retracting mechanism mounted on the housing, wherein the adapter comprises a first portion located between the inner and side wall of the at least one support, the first portion being secured to the inner runner and spaced apart from the side wall of the at least one support, the side wall of the at least one support opposing the side wall of the housing the securing mechanism is configured to secure the adapter, to the at least one support, the securing mechanism being positioned between the outer runner and a side wall of the adapter.

28. The domestic appliance as claimed in claim 27, wherein the entirety of the securing mechanism is between the outer runner and the side wall of the adapter.

29. The domestic appliance as claimed in claim 28, wherein the outer runner is secured to the housing and the inner runner is movable with respect to the outer runner.

30. The domestic appliance as claimed in claim 29, wherein the self retracting mechanism is separate from the plurality of runners.

31. The domestic appliance as claimed in claim 27, wherein the securing mechanism is located at the same position relative to the housing regardless of the number of runners included in the plurality of runners.

32. The domestic appliance as claimed in claim 31, wherein the plurality of runners includes at least one intermediate runner between the inner and outer runners.

33. The domestic appliance as claimed in claim 27, wherein the domestic appliance is a refrigerator or a freezer.

* * * * *

UNITED STATES PATENT AND TRADEMARK OFFICE

CERTIFICATE OF CORRECTION

PATENT NO. : 8,894,166 B2
APPLICATION NO. : 11/918498
DATED : November 25, 2014
INVENTOR(S) : Laible It is certified that error appears in the above-identified patent and that said Letters Patent is hereby corrected as shown below:

In the Claims,

Patent claim 27, column 10, line 26: "support opposing the side wall of the housing" should be corrected to --support opposing the side wall of the housing; and wherein--.

Signed and Sealed this
Fourteenth Day of April, 2015

Michelle K. Lee

Michelle K. Lee
*Director of the United States Patent and Trademark Office*